US005367993A

United States Patent [19]

Tulach et al.

[11] Patent Number: 5,367,993

[45] Date of Patent: Nov. 29, 1994

[54] VALVE COVER JOINT SEAL ASSEMBLY

[75] Inventors: John R. Tulach, Westchester; John A. Serio, Addison, both of Ill.

[73] Assignee: Navistar International Transportation Corp., Chicago, Ill.

[21] Appl. No.: 184,512

[22] Filed: Jan. 21, 1994

[51] Int. Cl.[5] ..... F01M 9/10

[52] U.S. Cl. ..... 123/90.38; 123/90.37; 123/193.3; 277/170; 277/235 B

[58] Field of Search ..... 123/90.27, 90.37, 90.38, 123/193.3, 193.5, 195 C; 277/170, 235 B

[56] References Cited

U.S. PATENT DOCUMENTS

| | | | |
|---|---|---|---|
| 3,184,247 | 5/1965 | Leutwyler | 277/170 |
| 3,822,763 | 7/1974 | Adams et al. | 123/90.38 |
| 4,027,644 | 6/1977 | Timour | 123/90.38 |
| 4,494,491 | 1/1985 | Takada et al. | 123/193.3 |
| 4,544,049 | 10/1985 | Shellhause | 277/170 |
| 5,101,777 | 4/1992 | Onishi et al. | 123/90.27 |
| 5,228,420 | 7/1993 | Furuya et al. | 123/90.38 |
| 5,285,754 | 2/1994 | Bell | 123/90.38 |

*Primary Examiner*—E. Rollins Cross
*Assistant Examiner*—Weilun Lo
*Attorney, Agent, or Firm*—Dennis K. Sullivan

[57] ABSTRACT

A valve cover assembly for an internal combustion engine has an integrally formed spark plug tube extending therethrough and into a cylinder head. The blind joint between the spark plug tube and the cylinder head surface against which it abuts is provided with a unique joint seal assembly wherein a flange surface generally parallel to the cylinder head surface is provided on the outer periphery of the tube and the tube is reversely tapered from the flange to the end thereof. An elastomeric sealing ring is mounted on and retained in place by the reverse taper below the flange and abuts against the cylinder head. The ring is thus retained on the tube during installation and removal of the valve cover from the cylinder head while growth of the ring due to the hot oil environment is accommodated by the radial extent of the flange surface.

20 Claims, 2 Drawing Sheets

VALVE COVER JOINT SEAL ASSEMBLY

BACKGROUND OF THE INVENTION

This invention relates to a valve cover joint seal assembly preferably for use in an internal combustion engine in sealing a blind joint between portions of a tubular element, such as a spark plug tube, which is partially formed in the engine valve cover and partially formed in the engine cylinder head, the joint seal assembly being configured in a manner which will retain a ring seal in position relative to the joint at all times, especially during installation and removal of the valve cover from the cylinder head.

THE PRIOR ART

Heretofore, as best shown in FIG. 1, in a spark plug tubes formed partially in the valve cover and partially in a cylinder head, sealing of the joint between the two sections of the tube has been accommodated by providing the adjoining end of the tube section in the valve cover with a terminal flange having a groove formed therein for receipt of an O-ring seal and by finishing the cylinder head surface around the head portion of the spark plug tube to form a smooth surface so that the O-ring seal will be compressed therebetween within the groove when the valve cover tube section is tightened against the cylinder head.

In this prior joint, the O-ring is not engaged to either tube section in a manner ensuring that it will not fall into the tube upon engagement and/or disengagement of the valve cover. Moreover, due to the formation of the blind joint beneath the valve cover, a mechanic does not become aware that misappropriate seating and a consequent failure of the O-ring to seal has occurred during installation of the valve cover but rather the failure will become apparent during subsequent use of the engine.

Further, in the prior art design, expansion of the O-ring due to environmental conditions, i.e., the exposure to hot engine oil, will be limited by the dimensions of the groove, placing stress on the material of the O-ring and decreasing its useful life.

SUMMARY OF THE INVENTION

As will be described in greater detail hereinafter, the locking joint seal assembly of the present invention overcomes the disadvantages described above by providing the valve cover assembly tube portion wherein the seal ring thereof is constantly maintained in engagement therewith, thereby accommodating with ease the formation of blind joints between the valve cover and the head without worry of loss of or mis-seating of the seal ring. In this design, the seal ring is allowed to expand radially while the compressed height in the axial direction between the cooperating compressive surfaces on the valve cover and on the head remains constant.

Accordingly, it is a primary object of the locking joint seal assembly of the present invention to provide a sealed blind joint wherein a compression seal ring thereof is locked onto one of the elements forming the joint so that it cannot escape from appropriate engagement thereon.

Another object of the locking joint seal assembly of the present invention to provide a sealed joint for an aperture extending through an internal combustion engine valve cover and a cylinder head wherein a compression seal ring thereof is locked onto the valve cover portion within the valve cover in a manner permitting installation and removal of the valve cover on the head without significant loss of the sealing capability of the joint.

A further object of the assembly is to provide a means for forming a blind joint seal between an internal combustion engine valve cover and a cylinder head where loss of the seal ring is never a concern.

It is yet a further object of the assembly to provide a constant seal compression height between the cooperating compressive surfaces of the elements joined together while permitting radial expansion of the seal ring.

These as well as other objects are met by the locking joint seal assembly of the present invention wherein the compression seal ring of the assembly is seated around a joint end of a tubular element, such as a spark plug tube through an engine valve cover, defining a portion of an aperture extending into a mating element, such as a spark plug hole in a cylinder head, with compression of the ring being created by a flange provided on the tubular element. The end of the tube about which the seal engages is provided with a reverse tapered configuration which maintains engagement of the seal on the tube at all times while the flange maintains a constant compressive height and force against the seal while permitting radial expansion thereof.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT(S)

Figure 1:
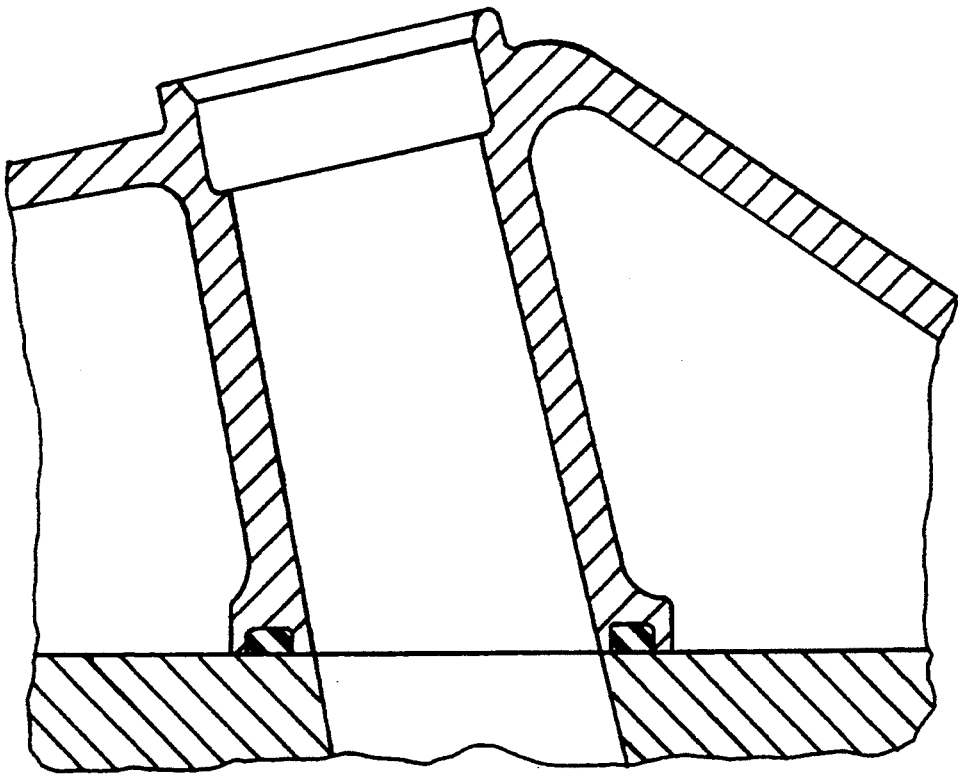
FIG. 1 PRIOR ART
FIG. 1 is a side sectional view of a prior art joint formed between two sections of a spark plug aperture, one section being formed by a tubular portion of a valve cover and the other section being drilled in a cylinder head.
Figure 2:
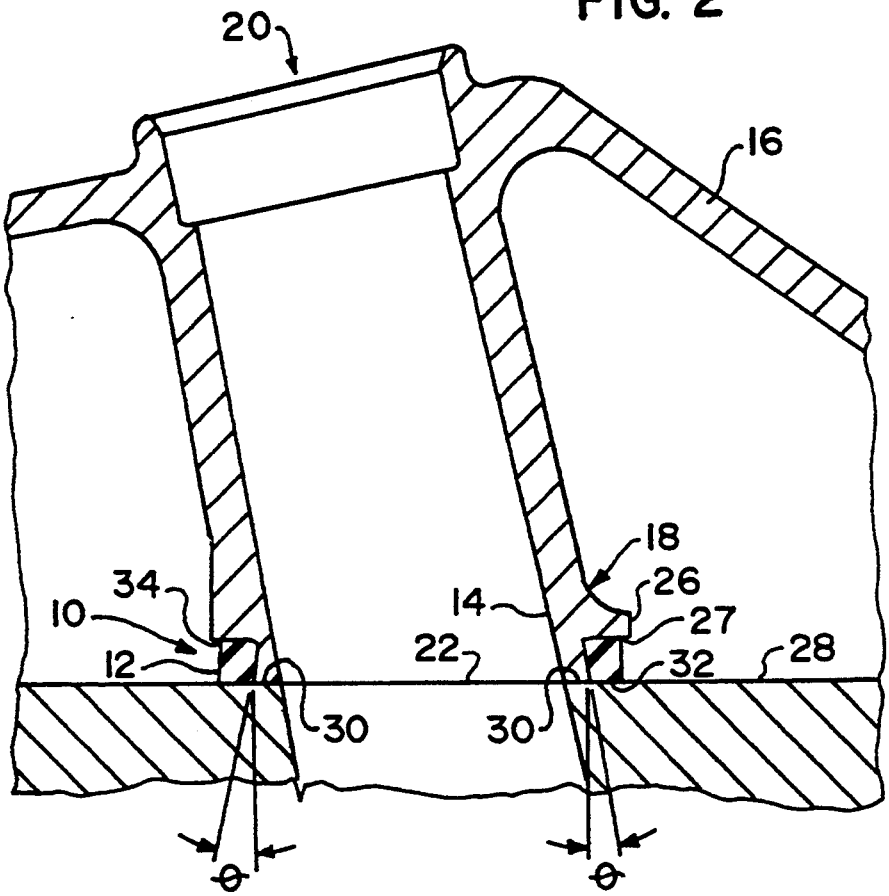
FIG. 2 is a side sectional view of the locking joint seal assembly of the present invention.

Referring now to the drawings in greater detail, there will be seen in FIG. 2 a locking joint seal assembly made in accordance with the teachings of the present invention and generally identified by the reference numeral 10 which is disposed between an engine valve cover 16 and a engine cylinder head 28.

As shown, a rectangular cross section elastomeric seal ring 12 is provided which is engaged about a uniquely configured end portion 14 of a cylindrical or tubular portion 18 of valve cover 16 which defines a spark plug tube or aperture 20 extending through the valve cover and into the cylinder head 28. Since the spark plug aperture 20 is external to the valve housing, the joint must be sealed to prevent oil from leaking from the valve housing into the aperture 20. Yet the joint 10 and particularly the seal ring 12 are not visible once the valve cover is moved into place. Although a valve cover mounting on a cylinder head is illustrated, it is evident that the invention described herein may be used at any such blind joint and, in its broader aspects, is not necessarily limited to the application illustrated herein.

Returning now to the tube section 18, it will be seen that the seal ring 12 rests circumferentially about the end 14 of tube section 18 and, in an uncompressed state would extend slightly past an end edge 22 thereof. The seal ring 12 is maintained in this position and kept from riding away from the end edge 22 of the tube section 18 by a circumferential flange 26 defining a generally radially extending flange or flange-like surface 27 provided about the periphery of the tube section 18 at such a position along the length of the tube section 18 to maintain the seal element 12 positioned appropriately at the end edge 22 of the tube section 18. If the wall thickness of tube section 18 is sufficiently large, the flange surface 27 may be formed simply by undercutting the outer diameter of the tube section 18.

Figure 3:
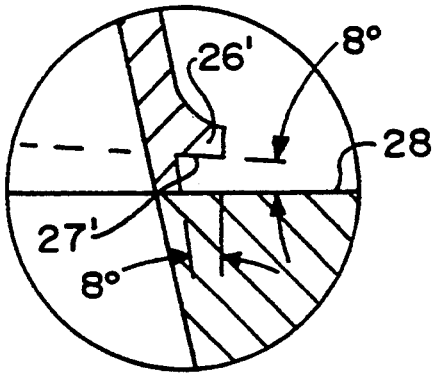
FIG. 3 is an enlarged view of a second embodiment of a seal engaging groove and flange of the assembly.

The flange surface 27 is formed to lie parallel to a smooth cooperating abutment surface 30 of the cylinder head 28 against which the tube section 18 is to be abutted. Alternatively, and as shown in FIG. 3, the flange surface 27' may be formed to taper radially outwardly and downwardly from parallel preferably at an angle of about 8°.

The abutment surface 30 of the cylinder head 28 disposed generally adjacent the aperture 20 with a bottom surface 32 of the seal ring 12 seating thereagainst. When the lower edge 22 of the tube section 18 with the seal ring 12 mounted thereon is abutted against the surface 30 of the cylinder head 28, the seal ring is compressed by the flange 26, causing a radially outward distortion of the seal ring 12. To maintain pressure along the entire width of the seal ring 12, the flange surface 27 is of such width as to accommodate the distorted width of the seal ring 12, even after radial expansion of the ring due to the hot oil environment.

A slot 34 defined along the tube section 18 between the end edge 22 and the flange surface 27 is determined empirically to produce the desired pressure or "squeeze" onto the seal ring 12 based upon the material used to create the seal ring 12. Further, if desired to assure that the force of the flange 26 against the seal ring 12 remains equalized as the seal ring 12 undergoes radial spread, the flange surface 27 may be angled to increase outer radial force against the thinner radially distorted area of the seal ring 12, as shown in FIG. 3.

It has been stated hereinabove that the seal ring 12 is "locked" onto the tube section 18 so that precise positioning thereof is assured even when the joint is blindly formed. This is accomplished by giving the end portion 14 of the tube section 18 a reverse taper configuration in the area defining the slot 34 within which the seal ring 12 is located, the end edge 22 thereof being widened to functionally engage the seal ring 12 thereon at all times. The angle $\theta$ of the reverse taper is measured relative to a line perpendicular to the line of seal contact (rather than the tube or aperture axes) and preferably is about 820 for this application. For larger seal ring diameters, a larger angle may be required, the angle $\theta$ being determined by the difference between the free state of the seal ring 12 and the maximum possible expanded state thereof as well as the compressed height of the seal ring.

With such secured, or locked on, engagement between the seal ring 12 and the end portion 14 of the tubular member 18, blind joints can be easily formed without worrying about appropriate positioning and seating of the seal ring 12.

As described above, the locking joint seal assembly of the present invention has a number of advantages, some of which have been described above and others of which are inherent in the invention. Also, modifications may be proposed to the locking joint seal assembly without departing from the teachings herein. Accordingly the scope of the invention is only to be limited as necessitated by the accompanying claims.

What is claimed is:

1. A joint seal assembly for a blind compression joint formed between an end of a cylindrical structure associated with an engine valve cover and an abutment surface disposed within said valve cover on an engine cylinder head, said joint seal assembly comprising:

a planar flange surface formed adjacent to and intersecting an outer periphery of the cylindrical structure, an outer peripheral edge of said flange surface being disposed parallel to said abutment surface a predetermined distance from said end of said structure;

said cylindrical structure having a reversely tapered end portion disposed between said flange surface and said structure end to provide a larger periphery at said end than the periphery thereof adjacent said flange surface; and an annular seal ring disposed on said reversely tapered end portion, said seal ring having an uncompressed height greater than said predetermined distance, an outer perimeter less than an outer perimeter of said flange surface, and an inner perimeter less than said larger perimeter of said structure end.

2. The joint assembly of claim 1 wherein said planar flange surface extends at an acute angle downwardly outwardly from an inner peripheral edge thereof to said outer peripheral edge.

3. The joint assembly of claim 2 wherein said acute angle is about 8° from parallel to said abutment surface.

4. The joint assembly of claim 1 wherein said cylindrical structure is a tubular member.

5. The joint assembly of claim 4 wherein said tubular member is integrally formed in an engine valve cover and said abutment surface is an engine cylinder head.

6. The joint assembly of claim 5 wherein said tubular member has a flange disposed on the periphery thereof, said flange surface being disposed on said flange.

7. The joint assembly of claim 1 wherein said reversely tapered end portion of said cylindrical structure is disposed at an acute angle relative to a line perpendicular to said abutment surface.

8. The joint assembly of claim 7 wherein said acute angle is about 8°.

9. A valve cover for enclosing a portion of an internal combustion engine cylinder head, said cylinder head having an aperture surrounded by an abutment surface, said valve cover comprising:

a main body portion; and a tubular portion integrally formed with said main body portion and extending to a distal end disposed to abut against said cylinder head abutment surface, said tubular portion defining a passage through said valve cover disposed to align with said cylinder head aperture, said tubular portion having a flange surface formed thereon to face said abutment surface, said flange surface intersecting a radially outer periphery of said tubular portion and being disposed a predetermined distance from said distal end.

10. The valve cover of claim 9 and said tubular portion having a reversely tapered end portion disposed between said flange surface and said distal end to provide a larger perimeter at said end than the perimeter thereof adjacent said flange surface.

11. The valve cover of claim 10 and an annular compressible sealing ring disposed on said tubular portion between said flange surface and said distal end, said compressible sealing ring extending a predetermined distance past said distal end prior to installation of said valve cover on said cylinder head, the inner perimeter of said sealing ring being smaller than said larger perimeter of said distal end of said tubular portion.

12. The valve cover of claim 10 wherein said reversely tapered end portion of said tubular portion is disposed at an acute angle relative to a line perpendicular to said abutment surface.

13. The valve cover of claim 12 wherein said acute angle is about 8°.

14. The valve cover of claim 9 wherein said flange surface is disposed parallel to said abutment surface.

15. The valve cover of claim 9 wherein said flange surface extends at an angle downwardly and outwardly relative to said abutment surface.

16. The valve cover of claim 15 wherein said angle is about 8° from parallel to said abutment surface.

17. The valve cover of claim 9 and an annular compressible sealing ring disposed on said tubular portion between said flange surface and said distal end, said compressible sealing ring extending a predetermined distance past said distal end prior to installation of said valve cover on said cylinder head.

18. A valve cover assembly for enclosing a portion of an internal combustion engine cylinder head, said cylinder head having an aperture surrounded by an abutment surface, said valve cover comprising:

a main body portion; and a tubular portion integrally formed with said main body portion and extending to a distal end disposed to abut against said cylinder head abutment surface, said tubular portion defining a passage through said valve cover disposed to align with said cylinder head aperture, said tubular portion having a flange surface formed thereon to face said abutment surface, said flange surface intersecting a radially outer periphery disposed a predetermined distance from said distal end, a periphery of said tubular portion between said flange surface and said distal end being reversely tapered to provide a larger diameter at said distal end than a diameter thereof at said flange surface; and an annular compressible sealing ring disposed on said tapered tubular portion between said flange surface and said distal end, an inner diameter of said sealing ring being smaller than said larger diameter of said distal end of said tubular portion to retain said sealing ring on said tubular portion.

19. The valve cover assembly of claim 18 wherein said flange surface is disposed parallel to said abutment surface.

20. The valve cover assembly of claim 18 wherein said flange surface extends at an angle downwardly and outwardly relative to said abutment surface.

* * * * *